US006395112B1

(12) United States Patent
Sitzmann et al.

(10) Patent No.: US 6,395,112 B1
(45) Date of Patent: May 28, 2002

(54) HYDROLYZABLE POLYMERS FOR EXPLOSIVE AND PROPELLANT BINDERS

(75) Inventors: Michael E. Sitzmann, Adelphi, MD (US); Horst G. Adolph, Warrenton, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/497,874

(22) Filed: Feb. 4, 2000

(51) Int. Cl.[7] ..... C06B 45/10
(52) U.S. Cl. ..... 149/19.4; 149/19.92
(58) Field of Search ..... 149/19.4, 19.92

(56) References Cited

U.S. PATENT DOCUMENTS

| | | | | | |
|---|---|---|---|---|---|
| 3,002,830 | A | | 10/1961 | Barr | 52/5 |
| 3,380,672 | A | * | 4/1968 | Lista | 149/19.4 |
| 3,586,551 | A | | 6/1971 | Nolan | 149/2 |
| 4,018,636 | A | | 4/1977 | O'Neill et al. | 149/19.4 |
| 4,156,700 | A | | 5/1979 | Tremblay et al. | 260/837 R |
| 4,293,352 | A | * | 10/1981 | Lee et al. | 149/19.4 |
| 4,456,493 | A | * | 6/1984 | Barnes et al. | 149/19.4 |
| 4,458,064 | A | * | 7/1984 | Chatterjee | 528/501 |
| 4,524,102 | A | * | 6/1985 | Hostettler | 528/52 |
| H351 | H | * | 10/1987 | Kim et al. | 149/19.4 |
| 4,799,980 | A | * | 1/1989 | Reed | 149/19.4 |
| 4,988,397 | A | * | 1/1991 | Adolph et al. | 149/19.3 |
| 5,525,171 | A | | 6/1996 | Finck et al. | 149/19.6 |

* cited by examiner

*Primary Examiner*—Michael J. Carone
*Assistant Examiner*—Aileen J. Baker
(74) *Attorney, Agent, or Firm*—Mark Homer

(57) ABSTRACT

A degradable polymer has an ester component adjacent to a poly(oxyethylene) component in the polymer chain. The hydrophilic nature of the poly(oxyethylene) draws water close to the ester in the polymer chain, which increases the rate of hydrolysis of the ester. The degradable polymer is useful as a binder in for explosive and propellant compositions.

17 Claims, No Drawings

HYDROLYZABLE POLYMERS FOR EXPLOSIVE AND PROPELLANT BINDERS

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention includes chemically curable polymers used in binders for explosives and propellents. More particularly, the polymers include an ester component adjacent to a poly(oxyethylene) component to increase the hydrophilic and hydrolyzing properties of the polymer. The polymers are easily degraded to recover explosive/propellent chemical components.

2. Brief Description of the Related Art

Chemically cured binders currently used in explosives and propellants are difficult to degrade at the end of their life-cycle. With the lack of easy degradation, the recovery of valuable components of the energetic composition is hindered.

Several types of binders are known in explosives and propellants. Polybutadiene or polyether structures contain no readily degradable groups. Binders containing ester groups alone, such as polycaprolactone or carboxy-terminated prepolymers cured with epoxides, possess hydrolyzable ester groups, but the conditions for hydrolysis, i.e., time, temperature, are severe.

There is a need in the art to provide binders for energetic materials with prepolymers containing more readily hydrolyzable moieties in the backbone to improve the degradability of explosive and propellant binders. The present invention addresses this and other needs.

SUMMARY OF THE INVENTION

The present invention includes a degradable polymer for explosive and propellant compositions having increased hydrophilicity and hydrolyzability comprising an ester component within the structure of the polymer and a poly (oxyethylene) component within the structure of the polymer, wherein the ester component is located proximate to the poly(oxyethylene) component.

The invention further includes a degraded explosive polymer product formed by the process comprising the steps of providing a degradable polymer for explosive and propellant compositions having increased hydrophilicity and hydrolyzability comprising an ester component within the structure of the polymer and a poly(oxyethylene) component within the structure of the polymer, wherein the ester component is located proximate to the poly(oxyethylene) component, and reacting the degradable polymer with a degrading chemical composition.

DETAILED DESCRIPTION OF THE PREFERRED EMBODIMENT

The present invention includes a degradable polymer used to form binders in explosive and propellant compositions. The degradable polymers have increased hydrophilicity and hydrolyzability. Polymers containing hydrolyzable groups within the polymer chain are used to create the binders, while providing hydroxy or carboxy groups at the polymer chain ends. The degradable polymers have both an ester component and a poly(oxyethylene) component within the chain structure of the polymer, with the ester component and poly(oxyethylene) component sufficiently close together in the chain to allow the hydrophilic ether component to attract water close to the ester component and increase reactions between the water and ester component. The chemically cured hydrolyzable polymers create binders that are useful in energetic materials, such as explosives and propellants.

The ester component and poly(oxyethylene) component are sufficiently proximate to each other to allow the hydrophilicity of the ether component to influence the hydrolysis of the ester component. Preferably, the number of carbon atoms between the ester component and poly(oxyethylene) component ranges from about three carbon atoms or less, more preferably from about two carbon atoms or less, and most preferably approximately one carbon atom. By limiting the number of carbon atoms between the ester component and poly(oxyethylene) component, the distance between these components is restricted.

When combined within the structure of the polymer, the poly(oxyethylene) component may be located on either side of the ester component, away from the chain oxygen or on the side of the chain oxygen, or on both sides of the ester group.

The formed polymer of the present invention may comprise a hydroxy-terminated polymer or a carboxy-terminated polymer, formed by any suitable process. Hydroxy-terminated polymers may be formed by controlling the stoichiometry of the reagents, as shown in equation (1), below. With proper stoichiometry selected, having the diol reagent present in an amount of x+1 and the diacid reagent present in an amount of x, a hydroxy-terminated polymer is formed.

$$(x+1)HO(CH_2CH_2O)_nH + (x)HOOC{-}R{-}COOH \xrightarrow{(-2xH_2O)} HO(CH_2CH_2O)_n[C(O){-}R{-}C(O)O(CH_2CH_2O)_n]_xH \quad (1)$$

with R representing a carbon or carbon heteroatom chain.

Additionally, hydroxy-terminated polymers may be formed, as shown in equation (2) below, with the diol reagent present in an amount of x+1 and the diacid reagent present in an amount of x.

$$(x+1)HO{-}R{-}OH + (x)HOOCCH_2O(CH_2CH_2O)_nCH_2COOH \xrightarrow{(-2xH_2O)} HO{-}R{-}O[C(O)CH_2O(CH_2CH_2O)_nCH_2C(O)O{-}R{-}O]_xH \quad (2)$$

Formation of carboxy-terminated polymers of the present invention may be achieved as shown in equation (3) below, by adjusting the stoichiometry of the reagents of the reaction of equation (1). With the diol reagent present in an amount of x and the diacid reagent present in an amount of x+1, a carboxy-terminated polymer is formed.

$$(x)HO(CH_2CH_2O)_nH + (x+1)HOOC{-}R{-}COOH \xrightarrow{(-2xH_2O)} \quad (3)$$

-continued $$HOOC—R—C(O)[O(CH_2CH_2O)_nC(O)—R—CO]_xOH$$

Additionally, carboxy-terminated polymers may be formed as shown in equation (4) below, by adjusting the stoichiometry of the reaction of equation (2). With the diol reagent present in an amount of x and the diacid reagent present in an amount of x+1, a carboxy-terminated polymer is formed.

$$(x)HO-R-OH + (x+1)HOOCCH_2O(CH_2CH_2O)_nCH_2COOH \xrightarrow{(-2xH_2O)} HOOCCH_2O(CH_2CH_2O)_nCH_2C(O)[O-R-C(O)OCH_2O(CH_2CH_2O)_nCH_2CO]_xOH \quad (4)$$

The prepolymers forming the binder comprise molecular weights suitable for processing, while enabling the formed binder to provide sufficient structural integrity to bind explosive and/or propellant compositions. The molecular weight of the prepolymers may range, for example, from about 2,000 to about 10,000; 2,500 to about 9,000; or 3,000 to about 8,000, with the proper molecular weight determinable by those skilled in the art for specific polymers and types of compositions.

Preferred hydroxy-terminated prepolymers include poly (PEG-400 adipate) having a polyethylene glycol component with a molecular weight of 400; poly(PEG-400 terephthalate) having a polyethylene glycol component with a molecular weight of 400; poly(PEG-400 poly(ethylene glycol) diacetic acid 604 ester) having a polyethylene glycol component with a molecular weight of 400 and an acid component with a molecular weight of 604; and poly(PCL-500 diol poly(ethylene glycol) diacetic acid 604 ester) having a polycaprolactone component with a molecular weight of about 500 and an acid component with a molecular weight of 604. Preferred carboxy-terminated prepolymers include poly(PCL-500 diol poly(ethylene glycol) diacetic acid 604 ester), having a polycaprolactone with a molecular weight of about 500 and an acid component with a molecular weight of 604. Of these, hydroxy-terminated poly(PEG-400 poly(ethylene glycol) diacetic acid 604 ester) and poly(PCL-500 diol poly(ethylene glycol) diacetic acid 604 ester) are most preferred.

When forming binders for energetic materials, the curing agent must be capable of reacting with the terminal groups on the prepolymers. When the terminal groups are hydroxyl groups, the di- or polyisocyanates are the preferred curing agents. Examples of suitable isocyanates include arylene polyisocyanates such as toluene diisocyanates; metaphenylene diisocyanate; 4-chloro-1, 3-phenylene diisocyanate; methylenebis-(4-phenyl isocyanate); 1, 5-naphthalene diisocyanate; 3, 3'-dimethoxy -4, 4'-biphenylene diisocyanate; 3, 3'-diphenyl-4, 4'-biphenylene diisocyanate; triphenylmethane triisocyanate; and alkylene poly-isocyanates such as methylene; ethylene; propane-1, 2; butane-1, 3; hexane-1, 6 and cyclohexane-1, 2 diisocyanates. Mixtures of polyisocyanates may also be used. ISOPHORON diisocyanate and Desmodur N-100 isocyanate curing agent, a commercial product of the Bayer Corp., Pittsburgh, Pa., are most often used. When the terminal groups are carboxyl groups, the useful curing agents include polyfunctional epoxides. The formed prepolymers possess a functionality suitable for curing with isocyanates or epoxides, with a preferred functionality of from about 1.7 to about 2.3, more preferably with a functionality of approximately 2.

Degradation of the polymers or formed binders may be performed by contact with a basic or acidic degrading chemical composition, such as a dilute base or acid composition. Contact between the polymers and degrading composition is enhanced with agitation, such as stirring or mixing. Dilute base or acid compositions include suitable concentrations, such as from about 2.0 N or less, 1.5 N or less, or 1.0 N or less, with the proper concentration for a particular polymer or binder determinable by those skilled in the art. Once the degrading composition is in contact with the polymer, the hydrophilic nature of the poly(oxyethylene) component facilitates drawing the polymer into the dilute base or acid. With the ester component located proximate to the poly(oxyethylene) component, the hydrolyzability of the polymer substantially improves during contact.

EXAMPLES

Examples 1–5 show the preparation of the polymers of the present invention which are useful to form binders for explosives and propellants. The hydrolyzability of the uncured polymers was tested by stirring a sample dissolved in water or, when not water-soluble, in dichloromethane or tetrahydrofuran, with 1.0 N hydrochloric acid at room temperature. After approximately 24 hours the molecular weight of the recovered material was determined by gel permeation chromatography (GPC) analysis. Example 6 shows that the polymers are curable with a conventional polyisocyanate such as Desmodur N-100.

Example 1

Preparation of Poly(PEG-400 Adipate) (Hydroxy-terminated)

A mixture of 2.4 g of PEG-400, 0.87 g of dimethyl adipate, and 0.1 g of p-toluenesulfonic acid was heated at 100° C. under a slow stream of dry nitrogen for 117 hours. After cooling the product was diluted with 10 mL of dichloromethane, 0.2 g of sodium hydrogen carbonate was added, after which the mixture was stirred for 30 minutes, filtered and separated from solvent in vacuo. The process obtained 2.8 g (97%) of a colorless oil. GPC analysis (PEG standards) indicated a peak molecular weight of 3,500.

Example 2

Preparation of Poly(PEG-400 Terephthalate) (Hydroxy-terminated)

A mixture of 2.4 g of PEG-400, 0.97 g of dimethyl terephthalate, and 0.1 g of p-toluenesulfonic acid was heated at 100° C. under a slow stream of nitrogen for 140 hours. Work-up as described in Example 1, above, gave 2.9 g (97%) of liquid polymer with a peak molecular weight of 2,500 (PEG standards).

Example 3

Preparation of Poly(PEG-400 Poly(ethylene Glycol) Diacetic Acid 604 Ester) (Hydroxy-terminated)

A mixture of 4.80 g of PEG-400, 5.43 g of polyethyleneglycoldiacetic acid (Hoechst Celanese Corp., molecular weight 604), and 0.3 g of ptoluenesulfonic acid was heated under a stream of nitrogen at 95° C.–100° C. for 24 hours. After cooling, the product was diluted with 20 mL of dichloromethane and the solution stirred for 1 hour with a saturated solution of 1 g of sodium hydrogen carbonate in water. Drying the dichloromethane phase (magnesium sulfate) and removing the solvent gave 9.4 g (96%) of polymer with a peak molecular weight of 3,500.

Example 4

Preparation of Poly(PCL-500 Diol Poly(ethylene Glycol) Diacetic Acid 604 Ester) (Hydroxy-terminated)

A mixture of 6.36 g of PCL-500, 5.43 g of polyethyleneglycoldiacetic acid (molecular weight 604), and 0.3 g of p-toluenesulfonic acid was heated at 95° C.–100° C. under a stream of nitrogen for 72 hours. Work-up as described in Example 3, above, gave 10.8 g (95%) of polymer with a peak molecular weight of 5,000.

Example 5

Preparation of Poly(PCL-500 Diol Poly(ethylene Glycol) Diacetic Acid 604 Ester) (Carboxy-terminated)

A mixture of 4.24 g of PCL-500 and 6.04 g of polyethyleneglycoldiacetic acid, having a molecular weight of 604, was heated at 100° C. under a stream of nitrogen for 4.5 days. After cooling, the polymer was dissolved in dichloromethane and the solution was washed twice with water. After drying (magnesium sulfate) and removal of the solvent 9.3 g (93%) a polymer with a peak molecular weight of 5,000 was obtained.

Example 6

Curing of Poly(PEG-400 Poly(ethylene Glycol) Diacetic Acid 604 Ester) with Desmodur N-100

An amount of 1 g of the hydroxy-terminated poly(PEG-400 poly(ethylene glycol) diacetic acid 604 ester) polymer obtained in Example 3 was mixed with 1 g of di-nbutylphthalate, 0.005 g of triphenylbismuth, and 0.136 g of Desmodur N-100 (NCO:OH ratio 1.1:1+10% excess NCO). The mixture was stirred with a glass rod until homogeneous and was then stored at 65° C. After 4 days, an elastomeric gumstock had formed.

The ease of the hydrolysis of the ester component of the polymers was found to be in the order of: PEG-400 and PEG diacetic acid 604 polyester>poly(PEG-400 adipate)>PCL-500 diol and PEG diacetic acid 604 polyester>poly(ethylene adipate)>poly(PEG-400 terephthalate)>polycaprolactone (which did not hydrolyze). The polyester from PCL-500 diol and PEG diacetic acid 604 was hydrolyzed completely in a dichloromethane solution that was stirred for 5 days with 1.0 N hydrochloric acid containing Fluorad™ Fluorochemical Surfactant FC-95 ($C_8F_{17}SO_3^{31}$ $K^+$), available from 3M Co. of Minneapolis, Minn.

Polymers of the present invention permit convenient processing of explosives or propellant that have outlasted their useful shelf life. The present invention provides telechelic polyesters derived from PEG diols, PCL diols and PEG diacetic acids with hydroxy or carboxy functionality, which are hydrolyzable by the action of dilute acid or base.

The foregoing summary, description, and examples of the present invention are not intended to be limiting, but are only exemplary of the inventive features which are defined in the claims.

What is claimed is:

1. A degradable polymer for explosive and propellant compositions, comprising:

an ester component within a backbone of the polymer; and, a poly(oxyethylene) component within the backbone of the polymer, wherein the ester component is located proximate to the poly(oxyethylene) component wherein hydrophilicity of the poly(oxyethylene) component increases hydrolyzability of the ester component.

2. The degradable polymer of claim 1, wherein the ester component and poly(oxyethylene) component are separated by from about three carbon atoms or less.

3. The degradable polymer of claim 2, wherein the ester component and poly(oxyethylene) component are separated by from about two carbon atoms or less.

4. The degradable polymer of claim 3, wherein the ester component and poly(oxyethylene) component are separated by one carbon atom.

5. The degradable polymer of claim 1, wherein the poly(oxyethylene) component is located on the side of the ester component away from the chain oxygen.

6. The degradable polymer of claim 1, wherein the poly(oxyethylene) component is located on the same side of the ester component as the chain oxygen.

7. The degradable polymer of claim 1, wherein the poly(oxyethylene) component is located on both sides of the ester component.

8. The degradable polymer of claim 1, wherein the polymer comprises a hydroxy-terminated polymer.

9. The degradable polymer of claim 1, wherein the polymer comprises a carboxy-terminated polymer.

10. The degradable polymer of claim 1, wherein the polymer comprises a functionality of from about 1.7 to about 2.3.

11. The degradable polymer of claim 1, wherein the polymer comprises a functionality of approximately 2.

12. The degradable polymer of claim 1, wherein the polymer comprises a polymer selected from the group consisting of poly(PEG-400 adipate), hydroxy-terminated; poly(PEG-400 terephthalate), hydroxy-terminated; poly (PEG-400 poly(ethylene glycol) diacetic acid 604 ester), hydroxy-terminated; poly(PCL-500 diol poly(ethylene glycol) diacetic acid 604 ester), hydroxy-terminated; and poly(PCL 500 diol poly(ethylene glycol) diacetic acid 604 ester), carboxy-terminated.

13. The degradable polymer of claim 12, wherein the polymer comprises poly(PEG-400 poly(ethylene glycol) diacetic acid 604 ester), hydroxy-terminated.

14. The degradable polymer of claim 1, wherein the polymer comprises poly(PCL-500 diol poly(ethylene glycol) diacetic acid 604 ester), hydroxy-terminated.

15. A binder comprising the degradable polymer of claim 1.

16. An explosive composition comprising the degradable polymer of claim 1.

17. A propellent composition comprising the degradable polymer of claim 1.

* * * * *